US005411194A

United States Patent [19]

Nagasawa et al.

[11] Patent Number: 5,411,194

[45] Date of Patent: May 2, 1995

[54] SHOULDER STRAP ASSEMBLY

[76] Inventors: Mitsuru Nagasawa, 411 N. Ynez Ave. #E, Monterey Park, Calif. 91754; John Tate, 3436 Marna Ave., Long Beach, Calif. 90808; R. Joseph Trojan, 4148 Inglewood Blvd. #203, Mar Vista, Calif. 90066

[21] Appl. No.: 7,979

[22] Filed: Jan. 22, 1993

[51] Int. Cl.[6] ..... A45F 3/14

[52] U.S. Cl. ..... 224/254; 224/257

[58] Field of Search ..... 224/254, 257, 264, 205; 267/85, 73; 2/324, 323

[56] References Cited

U.S. PATENT DOCUMENTS

| | | | |
|---|---|---|---|
| 609,731 | 8/1898 | Carley | 224/205 |
| 912,855 | 2/1909 | King | 267/85 |
| 1,734,371 | 11/1929 | Frost | 2/324 |
| 2,830,747 | 4/1958 | Creste . | |
| 3,323,698 | 6/1967 | Sottile | 224/264 |
| 3,747,654 | 10/1971 | Wilson | 150/1.5 R |
| 4,827,578 | 5/1989 | Heckerman | 24/265 |
| 4,925,064 | 5/1990 | Comera | 224/155 |
| 4,976,388 | 12/1990 | Coontz | 224/264 |
| 5,042,704 | 8/1991 | Izzo | 224/209 |
| 5,177,814 | 1/1993 | Courtney | 2/323 |

*Primary Examiner*—Renee S. Luebke
*Attorney, Agent, or Firm*—Trojan Law Offices

[57] ABSTRACT

The present invention provides a shoulder strap assembly that includes a padded strap member secured to a functional sub-assembly having a plurality of straps comprised of elastic material and at least one strap of inelastic material wherein the elastic straps may be of variable length thereby providing graduated resistance to reduce the bouncing action over a range of loads and wherein the inelastic strap is the load bearing strap included to provide primary support for the load when the elastic straps have reached their maximum length.

13 Claims, 2 Drawing Sheets

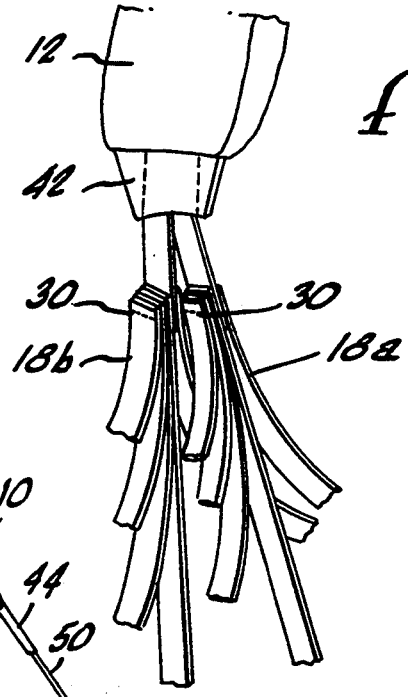
FIG. 1.
FIG. 2.
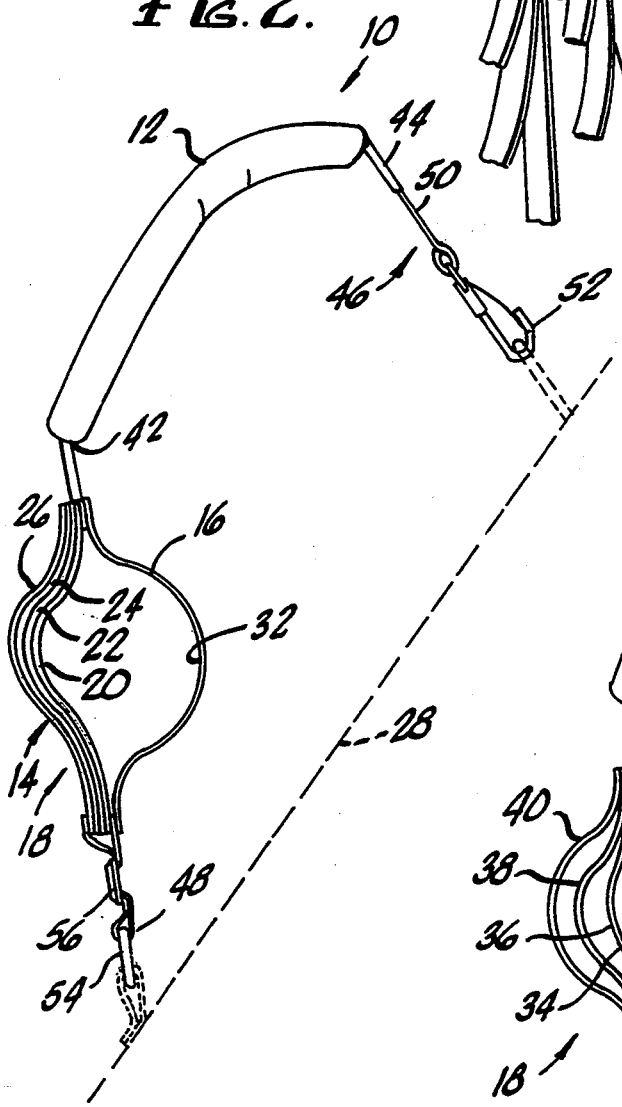
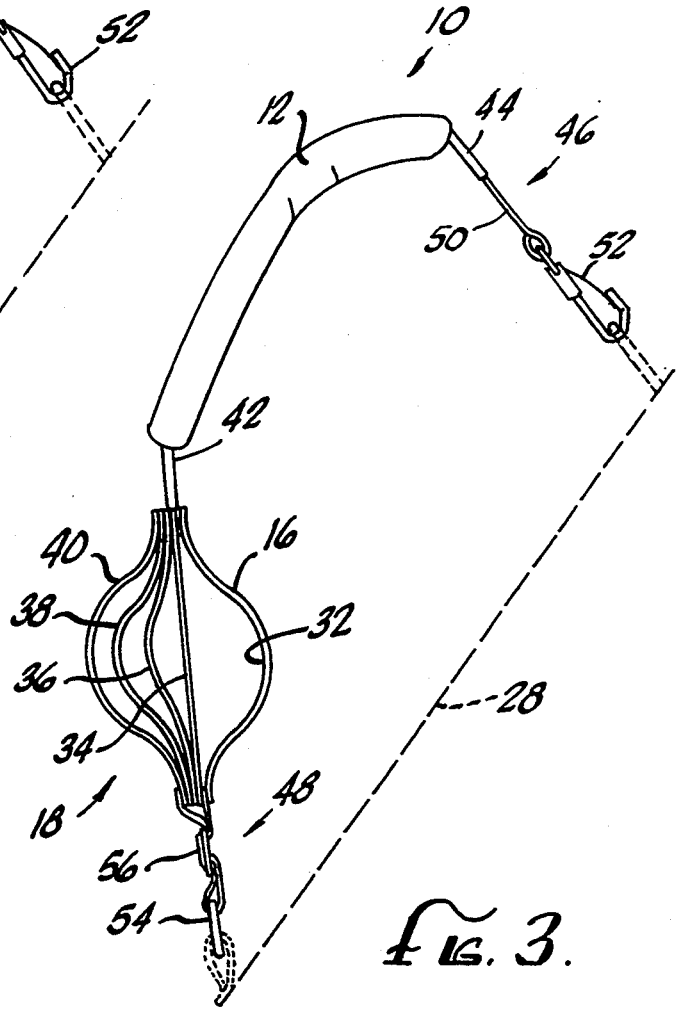
FIG. 3.

SHOULDER STRAP ASSEMBLY

BACKGROUND OF THE INVENTION

1. Field of the Invention

This invention relates to a strap assembly for carrying a load on one's shoulder wherein the assembly includes a padded shoulder strap secured to a functional subassembly having a plurality of straps comprised of elastic material and at least one strap of inelastic material. The plurality of elastic straps provide resistance to reduce the bouncing action of the load and consequent stress on the shoulder of the carrier. The elastic straps may be of variable length thereby providing graduated resistance to reduce the bouncing action over a range of load weights and conditions. The inelastic strap is the load bearing strap included to provide primary support for the load when the elastic straps have reached their maximum length.

2. Background of the Invention

One of the primary objectives of shoulder strap technology has been to minimize the stress that is transferred to the shoulder caused by the weight of the load. To minimize such stress on the shoulder, shoulder straps have typically included padding to absorb some of the shock of the load and also to distribute the load on the shoulder over a greater area of the shoulder for greater comfort. To reduce the bouncing action of the load, inventors have combined a totally resilient strap member with a non-stretchable strap member. The resilient strap member has served as both padding for the shoulder and as a shock absorber while the less resilient member has supported the load. This approach can be found in Coontz, U.S. Pat. No. 4,976,388, issued on Dec. 10, 1990 and in Heckerman, U.S. Pat. No. 4,827,578, issued on May 9, 1989.

One of the disadvantages of the prior art approach to the bouncing problem is that the resilient member typically has also served as the padding for the shoulder. This causes rubbing against the shoulder as the resilient member expands and contracts which can be a source of irritation. Additionally, the weight of the load has a tendency to stretch the resilient member to its maximum length and thus provides only limited protection from bouncing when the load is substantial.

Furthermore, when the resilient member has reached its maximum length, the weight of the load is born by the nonresilient or load bearing member. This is not a problem in itself. However, the load bearing member typically has been positioned above the resilient member. Hence, when the strap is in use, the resilient member is sandwiched between the shoulder and the load bearing strap. The force of the load bearing strap pressing the resilient strap against the shoulder can also interfere with the ability of the resilient strap to act as a shock absorber.

The present invention overcomes the problems in the prior art because the operational subassembly that dissipates the bouncing energy is not part of the padded member that comes in contact with the shoulder. Instead, the operational subassembly and padded shoulder strap member are positioned end to end. In this way, the resilient strap members do not come in contact with the shoulder. Therefore, the expansion and contraction of the resilient members do not rub against the shoulder. Furthermore, the load bearing strap does not trap the resilient strap members against the shoulder thereby allowing the resilient members to move freely in response to changing load forces.

SUMMARY OF THE INVENTION

One of the main objects of the present invention is to provide an improved shoulder strap that reduces the stress on the shoulder by reducing the bouncing action of the load.

Another object of the present invention is to provide an improved shoulder strap having a plurality of resilient strap means to provide greater resistance to counteract the downward force of the load.

A further object of the invention is to provide an improved shoulder strap having a plurality of resilient strap means of variable length to provide variable resistance to meet the variable range of downward forces that result from a bouncing load.

Yet another object of the present invention is to provide a shoulder strap assembly wherein the resilient straps do not contact the shoulder of the carrier thereby preventing the resilient strap members from chafing against the shoulder when the resilient strap members respond to a bouncing load.

An additional object of the present invention is to provide a shoulder strap assembly wherein the resilient strap means is not restricted by compression against the shoulder.

These and other objects and advantages of the present invention will become apparent from the following detailed description of the preferred embodiment of the invention without intending to limit the scope of the invention which is set forth in the appended claims.

BRIEF DESCRIPTION OF THE DRAWINGS

The advantages of the invention can be more clearly understood by reference to the drawings in which:

FIG. 1 is a right front perspective view of the invention;

FIG. 2 is a side view of the invention under no load;

FIG. 3 is a side view of an alternative embodiment of the invention under slight load;

DETAILED DESCRIPTION OF THE PREFERRED EMBODIMENT

Figure 4:
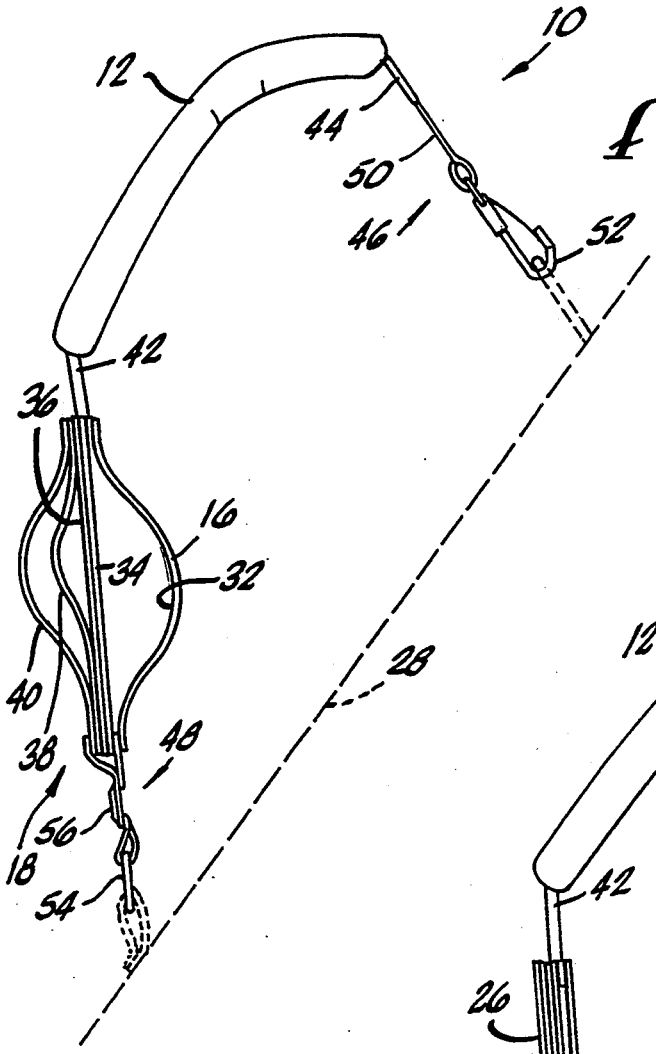
FIG. 4 is a side view of an alternative embodiment under greater load.

FIG. 2 generally illustrates the present invention, a multi-membered shoulder strap assembly 10. The strap assembly includes a conventional shoulder strap 12, a plurality of resilient strap members 14, and a nonresilient or load bearing strap member 16. The plurality of resilient strap members 14 and the load bearing member 16 are generally designated in combination as the functional or operational subassembly 18. In the embodiment illustrated in FIG. 2, there is a first, second, third, and fourth resilient strap member designated 20, 22, 24, and 26, respectively. But the invention is capable of operating with more or fewer resilient strap members.

The entire strap assembly is secured to a load 28 shown generically as a dotted line in the drawings. The functional subassembly 18 serves the primary function of absorbing fluctuations in the downward force of the weight of the load 28 caused by the natural bouncing action of the load 28.

In the preferred embodiment, the functional subassembly 18 is manufactured by starting with a suitable length of elongated, nonresilient strap material such as nylon to serve as the load bearing strap member 16. A suitable length for the load bearing strap member 16 for inclusion in a strap assembly 10 for attachment to a golf bag would be approximately 18 inches. The next step is to select a suitable length of elongated, resilient strap material such as elastic to serve as the resilient strap members 14. A suitable length for forming the resilient strap members 14 for inclusion in a strap assembly 10 for attachment to a golf bag would be approximately 26 to 30 inches.

Instead of cutting the elongated resilient material into separate lengths for each resilient strap member 14, the material may be folded back and forth on itself. For example, if the resilient starting material is 26 inches long, then the material may be folded back and forth on itself forming four resilient strap members 20 to 26, each of which will be 6.5 inches in length at rest. After the resilient material has been folded into resilient strap members 20 to 26, the material is positioned in parallel with the nonresilient material and the two are sown together preferably by stitching 30 at each end of the resilient strap members. Preferably, there should be two rows of stitching 30 for added strength.

Figure 5:
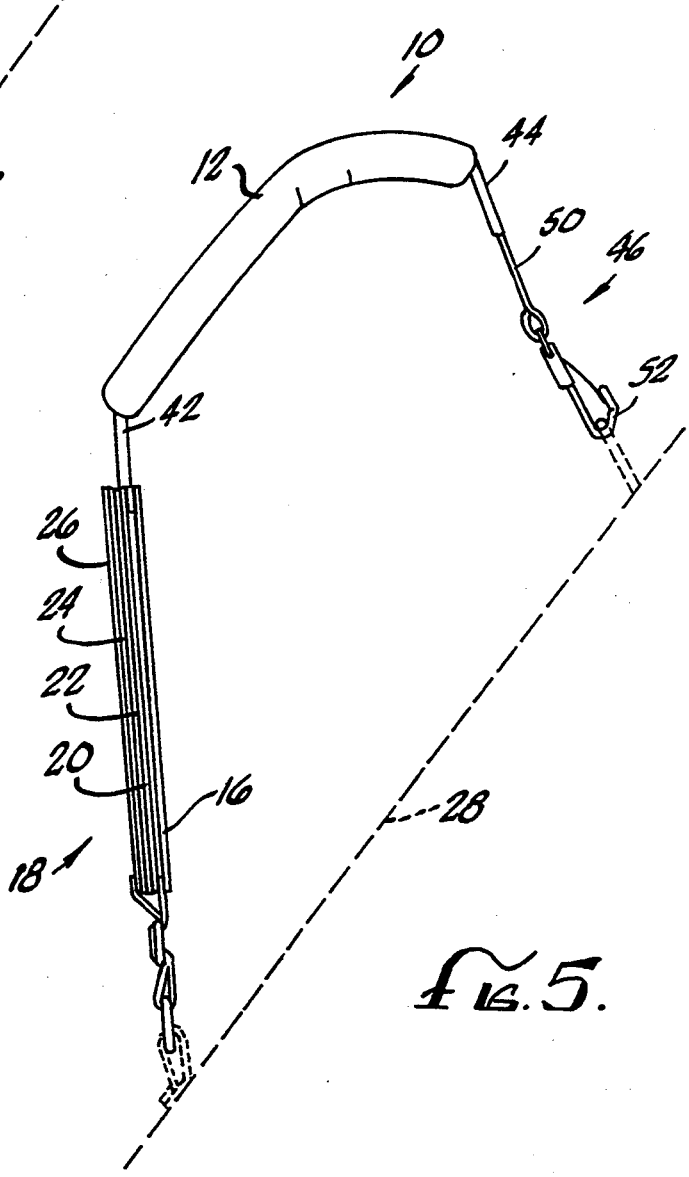
FIG. 5 is a side view of the invention under maximum load.

It is important that when the resilient and nonresilient materials are secured parallel to each other that the nonresilient member 16 be given some slack to form a loop 32 so that the nonresilient member 16 will not begin carrying the weight of the load until the plurality of resilient members 14 have approached their maximum ability to stretch. For example, if there are four resilient straps of 6.5 inches in length each, then the length of loop 32 should be approximately 9.5 inches. This leaves three inches for the resilient members 14 to stretch. It is preferable that the loop 32 be at least an inch or more shorter than the maximum length to which the plurality of resilient strap members 14 can be stretched so that the resilient members 20–26 will not be overloaded and will retain their elasticity for a longer time. FIG. 2 shows the elastic members 14 at rest with the load bearing member 16 not engaged. FIG. 5 show the elastic members at maximum stretch with load bearing member 16 fully engaged.

It should also be noted that two or more functional subassemblies 18 may be secured to the shoulder strap 12 to provide additional shock absorbing capacity as may be required by the particular application. In the case of a shoulder strap assembly 10 for use with a golf bag, two functional subassemblies **18*a* and 18*b* secured to the shoulder strap 12 are sufficient for the application as shown in FIG. 1**.

In an alternative embodiment, the plurality of resilient strap members are of different lengths as shown in FIG. 3. In this embodiment, the first strap member 34 is the shortest and fourth strap member 40 is the longest with the second and third strap members 36, 38 being of different intermediate lengths. When this embodiment is adopted, the first strap member 34 is activated by the weight of the load followed consecutively by the second, third and fourth strap members 36, 38, 40. It is important that the fourth strap member 40 be of such a length so that it engages before the first strap member 34 has reached its maximum stretch length. For example, if the first strap member 34 can stretch from six to nine inches, then the fourth strap member 40 must be less than nine inches to insure that it will engage before the first strap member 34 has reached its maximum length. In this example, the second and third strap members 36, 38 are shorter than the fourth strap member 40 so they engage before the fourth strap member 40.

When the load 28 bounces, the downward forces that cause stress on the shoulder are released in the form of kinetic energy that is required to stretch the first member 34. Any additional kinetic energy generated by the bouncing load 28 is consumed by the energy requirements necessary to stretch the additional elastic members rather than being transferred to the shoulder. The different lengths of elastic straps 34 to 40 provide for the graduated release of energy permitting the load 28 to rise and fall more smoothly for greater comfort. FIG. 3 shows the first elastic member 34 engaged and FIG. 4 shows the structure under an increased load where the second elastic member 36 is also engaged.

The shoulder strap 12 is preferably padded as generally shown in the drawings, but padding is not required. The shoulder strap 12 has a first end 42 and a second end 44. The functional subassembly 18 is secured to the padded shoulder strap 12 at the first end 42.

To secure the shoulder strap assembly 10 to the load, there is first load attachment means 46 that secures the second end 44 of the shoulder strap 12 to the load 28. The first load attachment means 46 is purely conventional in nature. In the embodiment shown in the drawings, the first load attachment means 46 includes a strap portion 50 sewn to the shoulder strap 12 and a conventional safety hook 52 securing the strap portion 50 to the load 28.

A second load attachment means 48 secures the functional subassembly 18 to the load 28. This second attachment means 48 is also conventional in nature. In the drawings, the second attachment means 48 includes a coupling 54 through which nonresilient strap member 16 is passed. Nonresilient strap member 16 is cinched through a buckle 56 thereby preventing the nonresilient strap member 16 from slipping out of the coupling 54.

The invention and its attendant advantages will be understood from the foregoing description and it will be apparent that various changes may be made without departing from the spirit of the invention.

We claim:

1. A shoulder strap assembly comprising:

an elongated shoulder strap having a first end and a second end;

a functional subassembly secured to said first end of said shoulder strap, said subassembly having an elongated load bearing strap member and a plurality of resilient strap members having variable lengths, said resilient strap members positioned parallel to said load bearing strap member, said load bearing member having a length that is longer than said lengths of said resilient strap members;

first and second load attachment means, said first load attachment means attached to said second end of said shoulder strap, said second load attachment means secured to said functional subassembly whereby said shoulder strap assembly may be secured to a load.

2. A shoulder strap assembly as in claim 1 wherein said plurality of resilient members is comprised of a single resilient. strap folded back and forth upon itself thereby forming said plurality of resilient members.

3. A shoulder strap assembly as in claim 1 wherein said attachment means is in the form of stitching.

4. A shoulder strap assembly as in claim 1 having a plurality of functional subassemblies.

5. A shoulder strap assembly as in claim 1 wherein said load is a golf bag.

6. A shoulder strap assembly comprising:

an elongated shoulder strap having a first end and a second end, said shoulder strap having padding;

a functional subassembly secured to said first end of said shoulder strap, said subassembly having an elongated load bearing strap member and a plurality of resilient strap members, each of said resilient strap members having different lengths, each of said resilient strap members having a length when at rest that is shorter than their respective lengths when a load is applied, said resilient strap members aligned parallel to said load bearing strap member, said load bearing member having a length that is longer than the longest of said resilient strap members at rest;

first and second load attachment means, said first load attachment means attached to said second end of said shoulder strap, said second load attachment means secured to said functional subassembly whereby said shoulder strap assembly may be secured to a load.

7. A shoulder strap assembly as in claim 6 wherein said plurality of resilient members is comprised of a single resilient strap folded back and forth upon itself thereby forming said plurality of resilient members.

8. A shoulder strap assembly as in claim 6 wherein said load bearing member is shorter than the length of said plurality of resilient strap members when at maximum stretch.

9. A shoulder strap assembly as in claim 6 wherein said plurality of resilient strap members and said load bearing member are secured together by stitching.

10. A shoulder strap assembly comprising:

an elongated shoulder strap member having a first end and a second end;

an elongated load bearing member secured to said first end of said shoulder strap and having a fixed length;

a plurality of resilient strap members having lengths at rest that are less than said fixed length of said load bearing member, each of said resilient straps having a proximal end and a distal end, said resilient strap members secured to said load bearing member by attachment means such that said resilient members and said load bearing member are in parallel to one another, said attachment means secured to said resilient straps in proximity to said distal ends and said proximal ends, said attachment means secured to said load bearing member at points that permit said load bearing member to form a loop that has a length that is shorter than said lengths of said resilient strap members when maximally stretched; and, first and second load attachment means, said first load attachment means attached to said second end of said shoulder strap, said second load attachment means secured to said load bearing member whereby said shoulder strap assembly may be secured to a load.

11. A shoulder strap assembly as in claim 10 wherein said attachment means is in the form of stitching.

12. A shoulder strap assembly as in claim 10 wherein said load is a golf bag.

13. A shoulder strap assembly as in claim 10 wherein said plurality of resilient members is comprised of a single resilient strap folded back and forth upon itself thereby forming said plurality of resilient members.

* * * * *